US007757672B2

(12) United States Patent
Villaire et al.

(10) Patent No.: US 7,757,672 B2
(45) Date of Patent: Jul. 20, 2010

(54) ANTI-CLOGGING FUEL PUMP MODULE

(75) Inventors: William L. Villaire, Clarkston, MI (US); Robert Halsall, Washington, MI (US); Mitchell E. Hart, Grand Blanc, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 23 days.

(21) Appl. No.: 12/210,234

(22) Filed: Sep. 15, 2008

(65) Prior Publication Data

US 2010/0065023 A1 Mar. 18, 2010

(51) Int. Cl.
*F02M 37/04* (2006.01)

(52) U.S. Cl. ..... 123/509; 123/510; 123/514

(58) Field of Classification Search ..... 123/509, 123/510, 511, 514, 457, 497
See application file for complete search history.

(56) References Cited

U.S. PATENT DOCUMENTS 5,148,792 A * 9/1992 Tuckey ..... 123/497
5,195,494 A * 3/1993 Tuckey ..... 123/514
5,398,655 A * 3/1995 Tuckey ..... 123/456
5,647,328 A * 7/1997 Fournier et al. ..... 123/509
5,706,785 A * 1/1998 Radermacher et al. ..... 123/457
5,762,048 A * 6/1998 Yonekawa ..... 123/514
5,809,975 A * 9/1998 Tuckey et al. ..... 123/509
5,873,349 A * 2/1999 Tuckey et al. ..... 123/514
5,960,775 A * 10/1999 Tuckey ..... 123/509
6,098,599 A * 8/2000 Muldoon et al. ..... 123/514
6,155,238 A * 12/2000 Briggs et al. ..... 123/509
6,158,975 A * 12/2000 Dill et al. ..... 417/307
6,253,740 B1 * 7/2001 Rembold ..... 123/509
6,371,088 B1 * 4/2002 Wheeler ..... 123/514
6,412,517 B1 * 7/2002 Flambert et al. ..... 137/550
6,457,460 B1 * 10/2002 Doane et al. ..... 123/541
6,527,947 B1 * 3/2003 Channing et al. ..... 210/136
6,932,061 B2 * 8/2005 Tsuruta ..... 123/514
7,032,575 B2 * 4/2006 Sims, Jr. ..... 123/509
7,040,299 B2 * 5/2006 Dickerson ..... 123/510
7,353,798 B2 * 4/2008 Tokuda et al. ..... 123/295
7,380,541 B1 * 6/2008 Ricco et al. ..... 123/447
7,410,022 B1 * 8/2008 Berg et al. ..... 180/190
7,475,678 B2 * 1/2009 Douyama et al. ..... 123/509
2002/0073972 A1 * 6/2002 Orsini et al. ..... 123/497
2006/0048752 A1 * 3/2006 Stroia et al. ..... 123/458

* cited by examiner

*Primary Examiner*—Thomas N Moulis

(57) ABSTRACT

A by-pass fuel system in which the plumbing of the fuel pump module is configured to ensure by-pass strained (and filtered) fuel remains separate from the reservoir fuel after by-pass such that it is not re-strained before re-entry to the fuel pump. The anti-clogging fuel pump module is plumbed such that the by-pass strained fuel is directed to the fuel pump separately with respect to the reservoir fuel, wherein it never mixes with reservoir fuel except after the reservoir fuel has passed through the strainer. Thus, the by-pass strained fuel only mixes with strained fuel from the strainer before its entry to the fuel pump. Accordingly, only reservoir fuel in the fuel pump module is passed through the strainer, whereby the clogging rate of the strainer is minimized.

2 Claims, 5 Drawing Sheets

ANTI-CLOGGING FUEL PUMP MODULE

TECHNICAL FIELD

The present invention relates to fuel pump modules which are interfaced with fuel tanks for motor vehicles, and more particularly to a by-pass fuel system in which strained (and filtered) by-pass fuel is sent directly to the fuel pump without being re-strained.

BACKGROUND OF THE INVENTION

Motor vehicle fuel tanks provide not only a reservoir for fuel but also must have accommodation for adding fuel, delivering fuel (i.e., to the engine) and monitoring the amount of the fuel therein. It has become a common practice to combine the fuel delivery and monitoring functions via a fuel pump module which is removably interfaced with an opening of the fuel tank outershell.

FIG. 1 depicts an example of a motor vehicle fuel tank 10 having, by way of example, a saddle shape featuring two fuel sumps 10*a*, 10*b*. The fuel tank outershell 12 is provided with first and second openings 12*a*, 12*b*, each opening being disposed over a respective fuel sump 10*a*, 10*b*. At the first sump 10*a*, and interfaced sealingly with the first opening 12*a*, is a fuel pump module 14, and at the second sump 10*b* and interfaced sealingly with the second opening 12*b* is a secondary fuel transfer source 16 which is fluidically connected to the fuel pump module 14 via a transfer line 18.

The fuel pump module 14 is part of a by-pass fuel system. With respect to by-pass fuel systems, there are feed and by-pass fuel lines which loop the fuel back to the fuel pump module or loop the fuel within the fuel pump module. The term "by-pass fuel system" refers to both "return fuel systems" and "mechanical returnless fuel systems". In the case of returnless fuel systems, a fuel pressure regulator is included with the by-pass fuel loop, being located within the fuel pump module.

FIG. 2 depicts a schematic representation of the functional aspects of a fuel pump module 20 utilized in the prior art, as for example in the manner of fuel pump module 14 in FIG. 1 with respect to a fuel tank of a return fuel system. A module reservoir 22 is defined by a plastic module sidewall 20*a*. A fuel pump 24 draws reservoir fuel $F_R$ through a strainer 26 in the module reservoir, and the strained fuel $F_S$ is then pumped by the fuel pump 24, and the strained pumped fuel $F_P$ is then delivered to the engine 40 via an inline fuel filter 28 and feed fuel line 30.

The by-pass fuel system continuously pumps fuel, and any amount not utilized by the engine is returned as a by-pass strained fuel $F_B$ to the fuel pump module 20 by an intersecting by-pass fuel line 32 with a fuel pressure regulator 34 located between the fuel pump 24 and the engine 40. The by-pass strained fuel $F_B$ is dumped via a standpipe 36 into the module reservoir 22. In this regard, because the by-pass strained fuel $F_B$ dumpingly mixes with the reservoir fuel $F_R$ already in the module reservoir, it becomes no longer separate as a uniquely identifiable entity and becomes merely a mixed aspect of the reservoir fuel $F_R$ component, wherein all of the reservoir fuel must be strained before entry to the fuel pump.

In that a conventional fuel pump module of a by-pass fuel system dumps and mixes the by-pass strained fuel $F_B$ with the reservoir fuel $F_R$, all fuel entering into the fuel pump must be strained in order to remove any contaminants from the fuel regardless of the fact that some of the fuel may have been previously strained. This requirement to strain all fuel entering the fuel pump irrespective of past strain history of the fuel requires the fuel pump to work harder than it might otherwise have to if somehow the strained fuel could remain separate. Further, the mixing of the by-pass strained fuel $F_B$ with the reservoir fuel $F_R$ causes the strainer to pass therethrough more fuel, with attendant clogging aspects, than would otherwise be necessary if somehow the strained fuel could remain separated from the reservoir fuel and somehow be able to pass to the fuel pump without being re-strained.

Accordingly, it would be desirable for by-pass fuel systems if somehow the by-pass strained fuel could remain separate from the reservoir fuel after by-pass such that it would not have to be re-strained before entry to the fuel pump.

SUMMARY OF THE INVENTION

The present invention is a by-pass fuel system in which the plumbing of the fuel pump module is configured such that the by-pass strained fuel remains separate from the reservoir fuel after by-pass such that it is not re-strained before re-entry to the fuel pump.

The anti-clogging fuel pump module according to the present invention is plumbed to ensure the by-pass strained (and filtered) fuel is directed to the fuel pump separately with respect to the reservoir fuel, wherein it never mixes with reservoir fuel except after the reservoir fuel has passed through the strainer. Thus, the by-pass strained fuel only mixes with strained fuel from the strainer before its entry to the fuel pump. Accordingly, only reservoir fuel in the fuel pump module is passed through the strainer, whereby the clogging rate of the strainer is minimized.

A benefit of the anti-clogging fuel pump module is that it allows the fuel pump to preferentially utilize the by-pass strained fuel, thereby reducing the relative flow rate of the fuel pump reservoir fuel (unstrained fuel) through the strainer attached to the fuel pump. This reduction in the reservoir fuel (unstrained and potentially "dirty" fuel) flow through the strainer will reduce the capture of fine sediment particles in and on the strainer, wherein such particles tend to clog the strainer. Other benefits of the present invention include a potential cleaning effect of the outer surface of the strainer by flow of the by-pass strained fuel, a potential reduction of fuel pump wear, an improvement in the hot fuel handling capabilities of the fuel pump by increasing the fuel pressure (reducing fuel vapor formation in the fuel pump) at the inlet of the pump, and reduction of the volatility of the fuel due to direct recirculation of strained fuel and vapor stripping of the fuel being pumped.

Accordingly, it is an object of the present invention to provide a by-pass fuel system in which the plumbing of the fuel pump module is configured such that the by-pass strained fuel remains separate from the reservoir fuel after by-pass such that it is not re-strained before re-entry to the fuel pump.

This and additional objects, features and advantages of the present invention will become clearer from the following specification of a preferred embodiment.

DESCRIPTION OF THE PREFERRED EMBODIMENT

Figure 1:
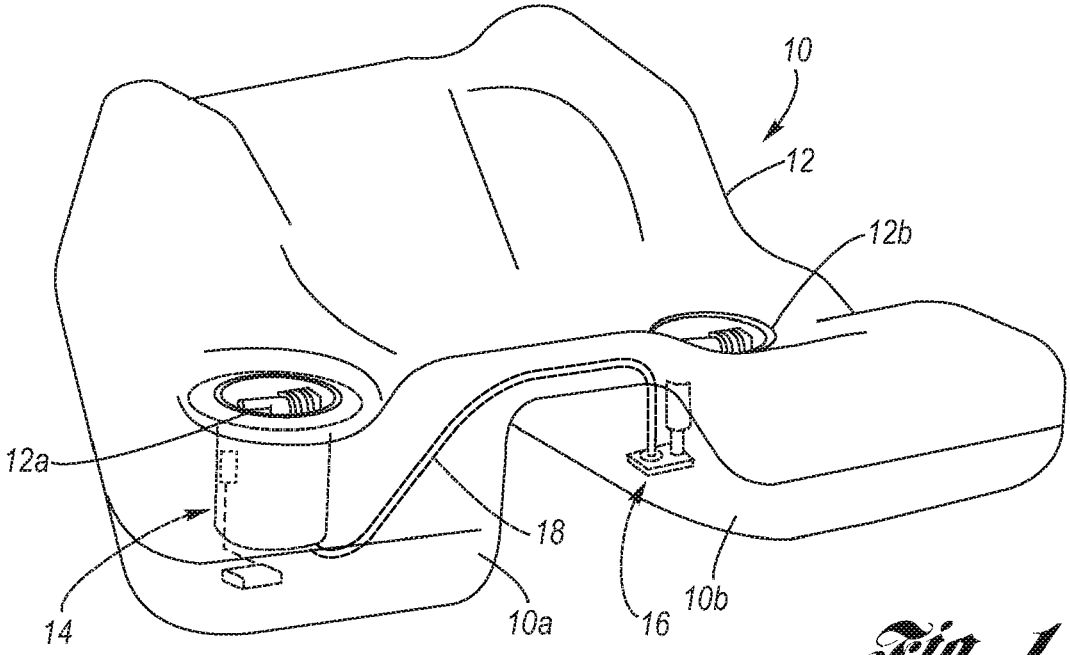
FIG. 1 is a perspective view of a fuel tank, showing in particular a fuel pump module interfaced therewith.
Figure 2:
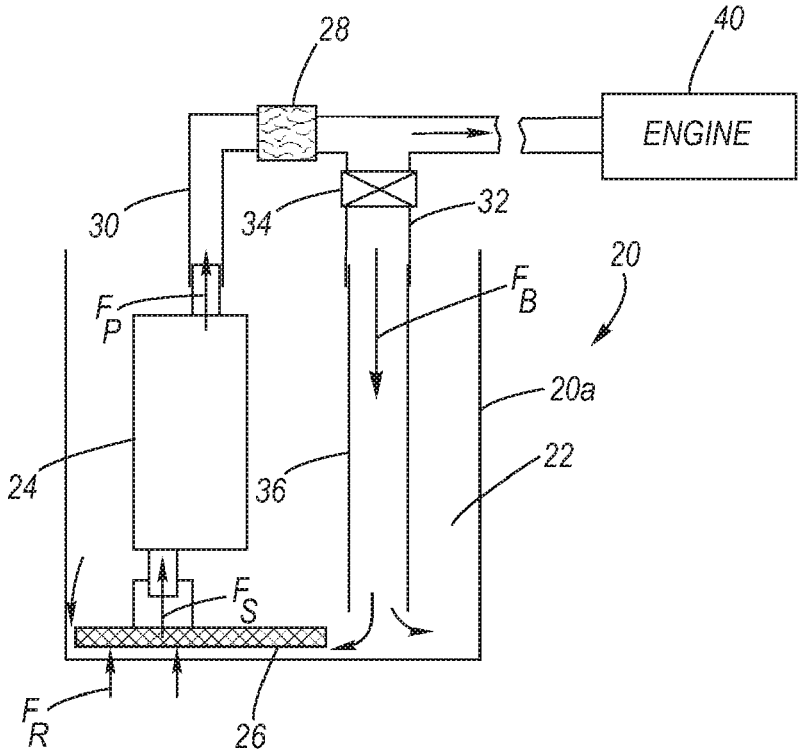
Prior Art Fig. 2
FIG. 2 is a schematic representation of a prior art fuel pump module for a fuel tank of a by-pass fuel system.

Referring now to the Drawing, FIGS. 3A through 5 depict various aspects of an anti-clogging fuel pump module 100 for a fuel tank of a by-pass fuel system, wherein the by-pass strained fuel remains separate from the reservoir fuel (i.e., it retains its unique identity) after by-pass such that it is not mixed with the reservoir fuel upstream of the strainer, but rather mixed with strained fuel downstream of the strainer before delivery to (i.e., upstream of) the fuel pump.

Figure 3A:
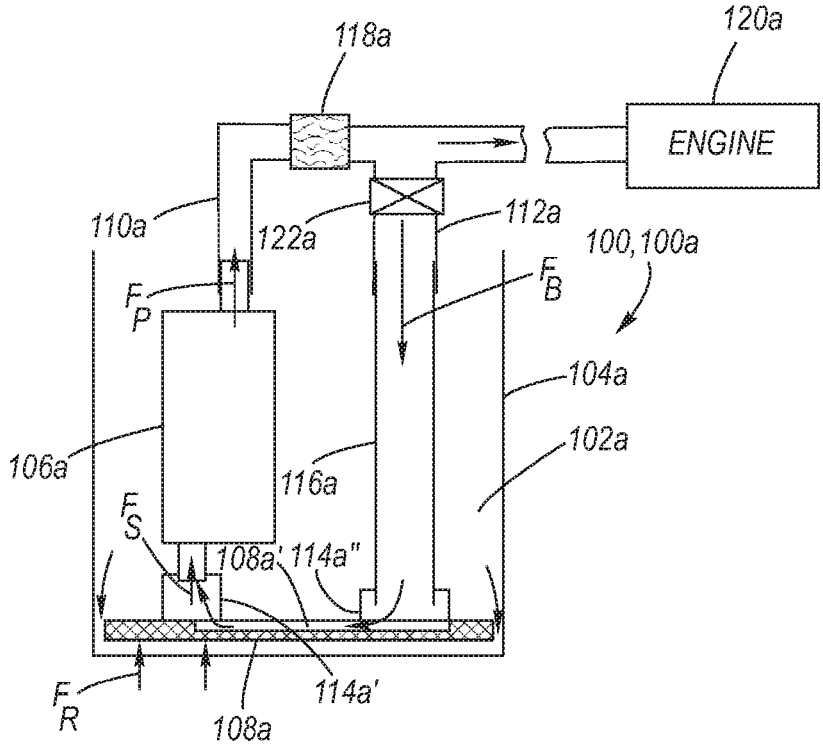
FIG. 3A is a schematic representation of a first example of a preferred embodiment of the anti-clogging fuel pump module for a fuel tank of a by-pass fuel system according to the present invention.

Referring now to FIG. 3A, a first schematic example of the anti-clogging fuel pump module 100, 100*a* is depicted, utilized as for example in the manner of fuel pump module 14 in FIG. 1 with respect to a fuel tank of a by-pass fuel system.

The fuel pump module 100*a* has a module reservoir 102*a* defined by a plastic module sidewall 104*a*. Strained fuel $F_S$ which has passed through a strainer 108*a* is pumped by a fuel pump 106*a*, and delivered as strained pumped fuel $F_P$ to the engine 120*a* via an in-line fuel filter 118*a* and feed fuel line 110*a*, wherein strained pumped fuel not utilized by the engine is by-passed, via an intersecting by-pass fuel line 112*a* with a fuel pressure regulator 122*a* located between the fuel pump 106*a* and the engine 120*a*, as by-pass return strained fuel $F_B$.

The strainer 108*a* has two ports, a first port 114*a*' for delivery of strained fuel $F_S$ to the fuel pump 106*a*, and a second port 114*a*" which communicates with a standpipe 116*a* which is, in turn, connected to the by-pass fuel line 112*a*. The second port communication is plumbed so as to be exclusive with respect to the by-pass strained fuel $F_B$ (i.e., there is no communication with the reservoir fuel $F_R$). Strained pumped fuel $F_P$ not used by the engine is by-passed, through the by-pass fuel line 112*a* and the pressure regulator 122*a*, into the standpipe 116*a* and then into an internal channel 108*a*' of the strainer 108*a*, whereby the by-pass strained fuel $F_B$ is directly recirculated into the fuel pump 106*a*. Reservoir (bulk) fuel $F_R$ is also drawn into the strainer 108*a* to augment the fuel flow requirement of the engine. All the components are contained within the fuel pump module reservoir 102*a* with the possible exception of the pressure regulator which may be located remotely in the vehicle architecture.

Figure 3B:
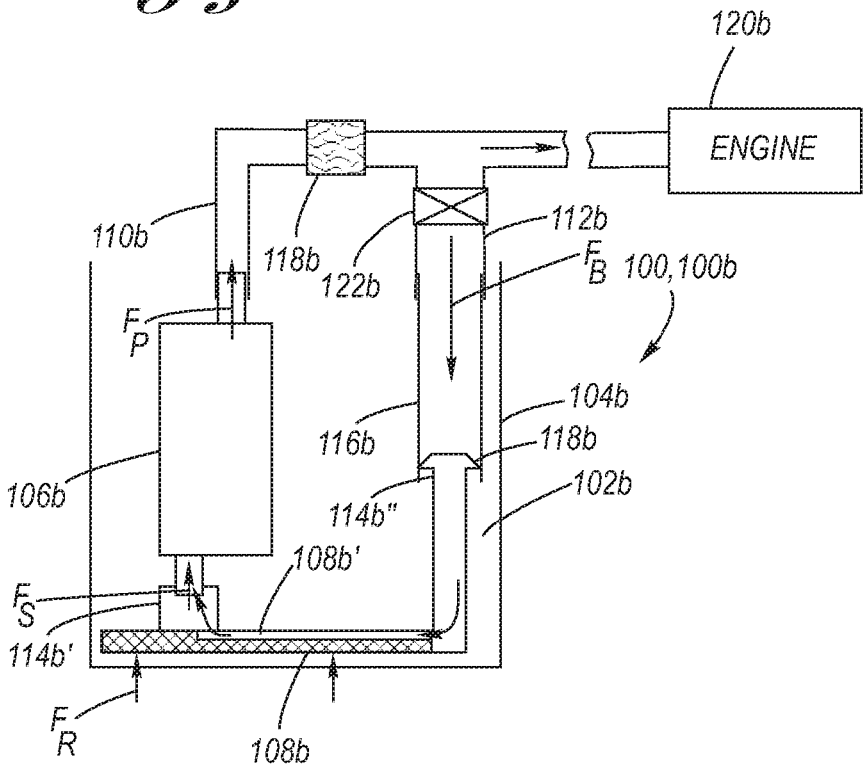
FIG. 3B is a schematic representation of a second example of the preferred embodiment of the anti-clogging fuel pump module for a fuel tank of a by-pass fuel system according to the present invention.

Referring now to FIG. 3B, a second schematic example of the anti-clogging fuel pump module 100, 100*b* is depicted, utilized as for example in the manner of fuel pump module 14 in FIG. 1 with respect to a fuel tank of a by-pass fuel system.

The fuel pump module 100*b* has a module reservoir 102*b* defined by a plastic module sidewall 104*b*. Strained fuel $F_S$ which has passed through a strainer 108*b* is pumped by a fuel pump 106*b*, and delivered as strained pumped fuel $F_P$ to the engine 120*b* via an in-line fuel filter 118*b* and feed fuel line 110*b*, wherein strained pumped fuel not utilized by the engine is by-passed, via an intersecting by-pass fuel line 112*b* with fuel pressure regulator 122*b* located between the fuel pump 106*b* and the engine 120*b*, as by-pass return strained fuel $F_B$.

The strainer 108*b* has two ports, a first port 114*b*' for delivery of strained fuel $F_S$ to the fuel pump 106*b*, and a second port 114*b*" which communicates with a standpipe 116*b* which is, in turn, connected to the by-pass fuel line 112*b*. The second port communication is plumbed so as to be exclusive with respect to the by-pass strained fuel $F_B$ (i.e., there is no communication with the reservoir fuel $F_R$). Strained pumped fuel $F_P$ not used by the engine is by-passed, through the by-pass fuel line 112*b* and the fuel pressure regulator 122*b*, into the standpipe 116*b* and then into a strained-fuel-side internal channel 108*b*' of the strainer 108*b*, whereby the by-pass strained fuel $F_B$ is directly recirculated into the fuel pump 106*b*. Reservoir (bulk) fuel $F_R$ is also drawn into the strainer 108*b* to augment the fuel flow requirement of the engine.

The fuel pump module 100*b* differs from the fuel pump module 100*a* in that the second port 114*b*" is inserted sealingly by a seal 118*b* into the standpipe 116*b*, thereby allowing the by-pass fuel flow to be directed along the entire internal channel 108*b*' of the strainer 108*b*, wherein the strainer is also completely contained within the module reservoir.

Figure 3C:
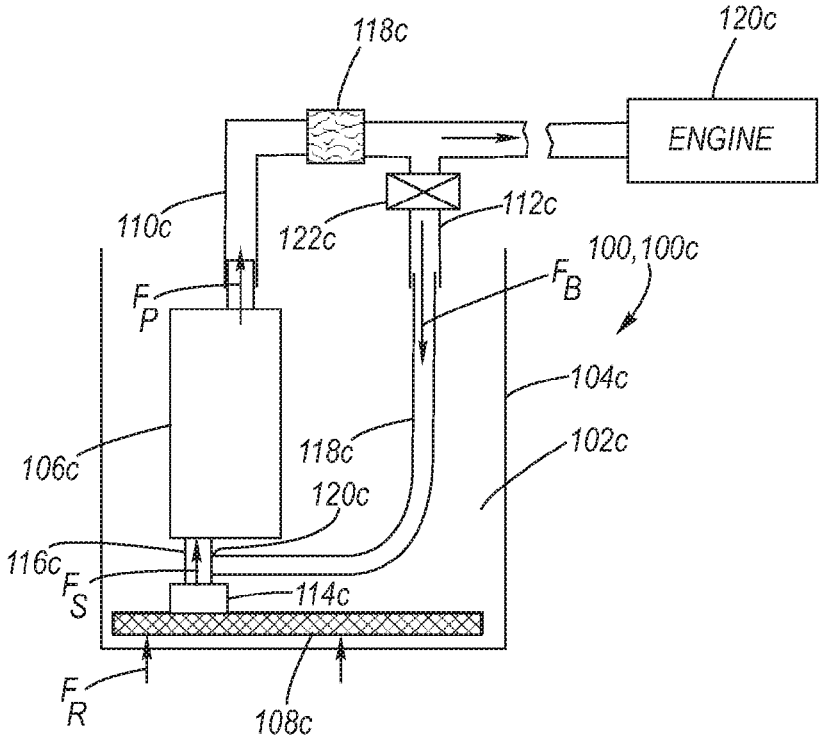
FIG. 3C is a schematic representation of a third example of the preferred embodiment of the anti-clogging fuel pump module for a fuel tank of a by-pass fuel system according to the present invention.

Referring now to FIG. 3C, a third schematic example of the anti-clogging fuel pump module 100, 100*c* is depicted, utilized as for example in the manner of fuel pump module 14 in FIG. 1 with respect to a fuel tank of a by-pass fuel system.

The fuel pump module 100*c* has a module reservoir 102*c* defined by a plastic module sidewall 104*c*. Strained fuel $F_S$ which has passed through a strainer 108*c* is pumped by a fuel pump 106*c*, and delivered as strained pumped fuel $F_P$ to the engine 120*c* via an inline fuel filter 122*c* and feed fuel line 110*c*, wherein strained pumped fuel not utilized by the engine is by-passed, via an intersecting by-pass fuel line 112*c* with a fuel pressure regulator 122*c* located between the fuel pump 106*c* and the engine 120*c*, as by-pass strained fuel $F_B$.

The strainer 108*c* has a single port 114*c* for delivery of strained fuel $F_S$ to the fuel pump 106*c* via a fitting 116*c*. In the fuel pump module 100*c*, rather than a standpipe, a by-pass tube 118*c*, which may be flexible or rigid, directly connects to the fitting 116*c* downstream of the strainer 108*c* and upstream of the fuel pump 106*c*, via a side port 120*c*, wherein there is no communication with the reservoir fuel $F_R$. Strained pumped fuel $F_P$ not used by the engine is by-passed, through the by-pass fuel line 112*c* and the fuel pressure regulator 122*c*, into the by-pass tube to the fuel pump 106*c*, whereby the by-pass strained return fuel $F_B$ is directly recirculated into the fuel pump. Reservoir (bulk) fuel $F_R$ is also drawn into the strainer 108*c* to augment the fuel flow requirement of the engine, wherein the strainer is also completely contained within the module reservoir.

Figure 3D:
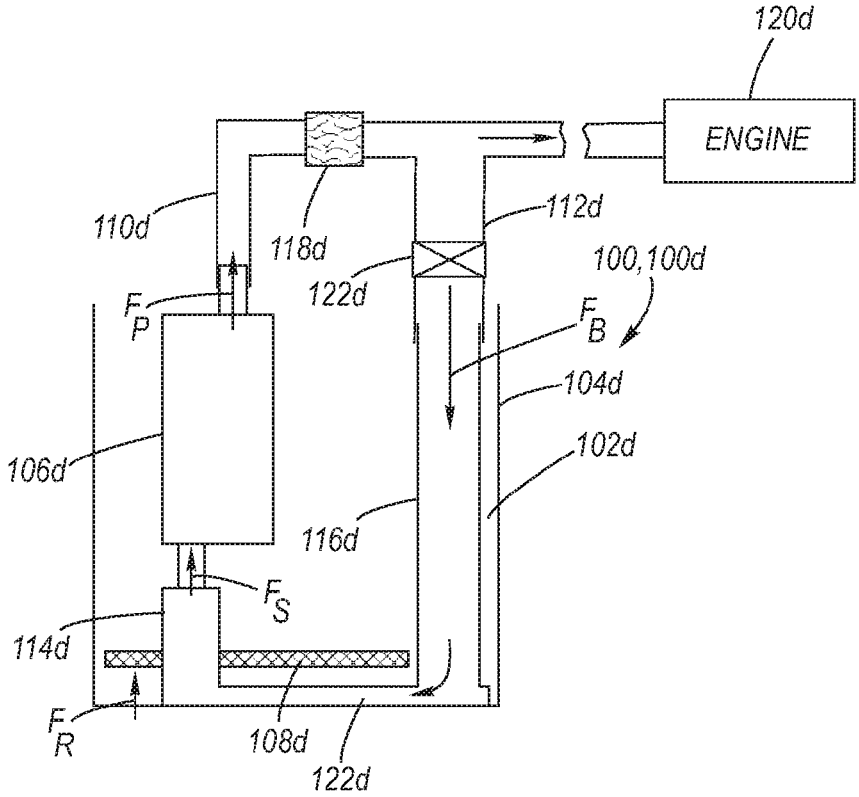
FIG. 3D is a schematic representation of a fourth example of the preferred embodiment of the anti-clogging fuel pump module for a fuel tank of a by-pass fuel system according to the present invention.

Referring now to FIG. 3D, a fourth schematic example of the anti-clogging fuel pump module 100, 100*d* is depicted, utilized as for example in the manner of fuel pump module 14 in FIG. 1 with respect to a fuel tank of a by-pass fuel system.

The fuel pump module 100*d* has a module reservoir 102*d* defined by a plastic module sidewall 104*d*. Strained fuel $F_S$ which has passed through a strainer 108*d* is pumped by a fuel pump 106*d*, and delivered as strained pumped fuel $F_P$ to the engine 120*d* via an in-line fuel filter 122*d* and feed fuel line 110*d*, wherein strained pumped fuel not utilized by the engine is by-passed, via an intersecting by-pass fuel line 112*d* with fuel pressure regulator 122*d* located between the fuel pump 106*d* and the engine 120*d*, as by-pass strained fuel $F_B$.

The strainer 108*d* communicates with a strainer fitting 114*d* through which is provided delivery of strained fuel $F_S$ to the fuel pump 106*d*. In the fuel pump module 100*d*, a standpipe 116*d* connects to the by-pass fuel line 110*d* and an external channel 122*d*. The external channel 122*d*, in turn, connects to the strainer fitting 114*d*. Strained pumped fuel $F_P$ not used by the engine is by-passed through the by-pass fuel line 112*d* and fuel pressure regulator 122*d* into the strainer fitting 114*d* to the fuel pump 106*d*, whereby the by-pass strained fuel $F_B$ is directly recirculated into the fuel pump. Reservoir (bulk) fuel $F_R$ is also drawn into the strainer 108*d* and then into the strainer fitting to augment the fuel flow requirement of the engine, wherein the strainer is also completely contained within the module reservoir, and wherein the strainer is also completely contained within the module reservoir.

In the examples of FIGS. 3A through 3D, heat transfer plumbing, or a heat exchanger may be provided in the module reservoir as needed according to standard practices in the art in order to eliminate fuel heating and/or aging effects.

Figure 4:
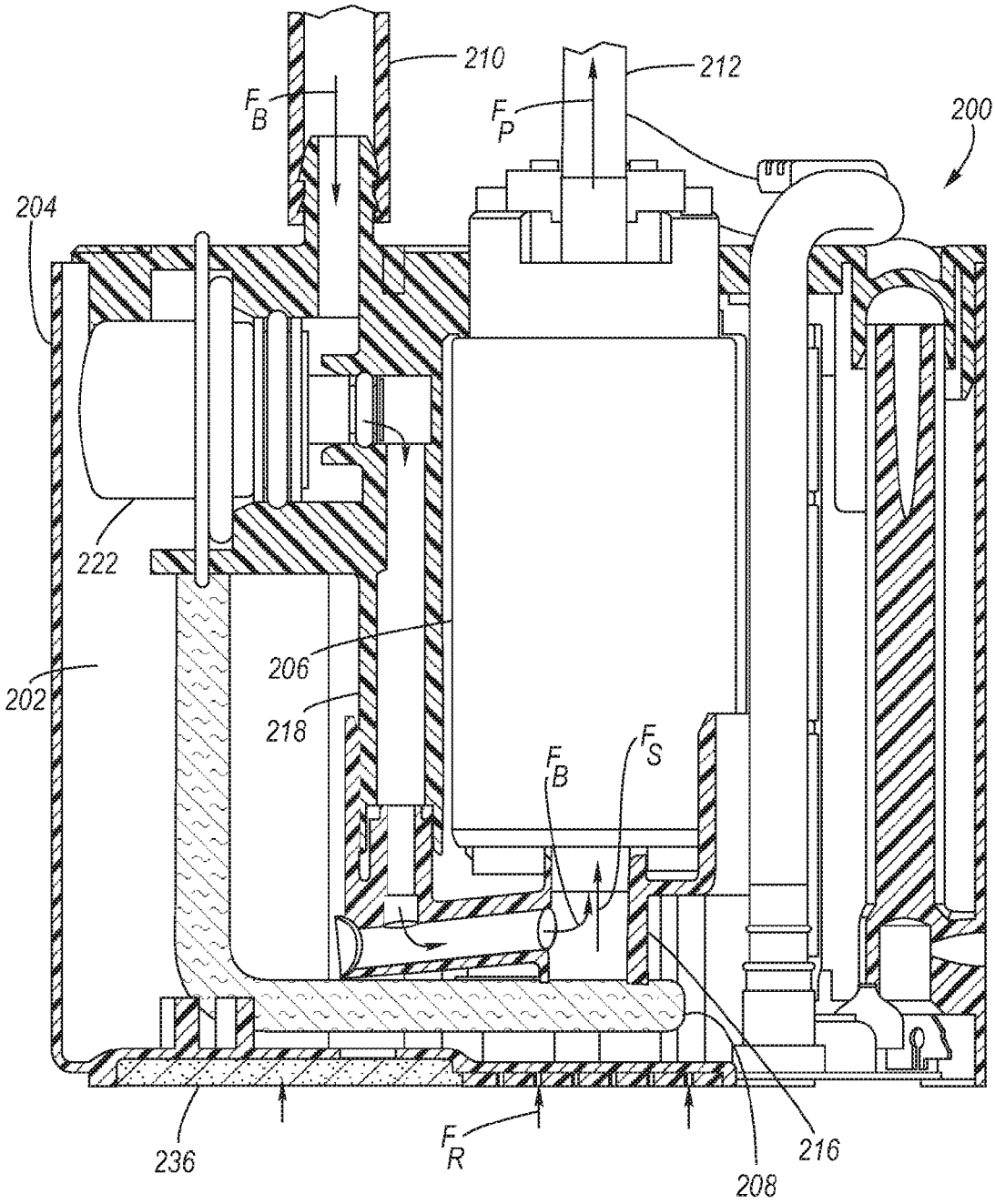
FIG. 4 is a partly sectional side view of an implementation of the preferred embodiment of the anti-clogging fuel pump module for a fuel tank of a by-pass fuel system according to the present invention.
Figure 5:
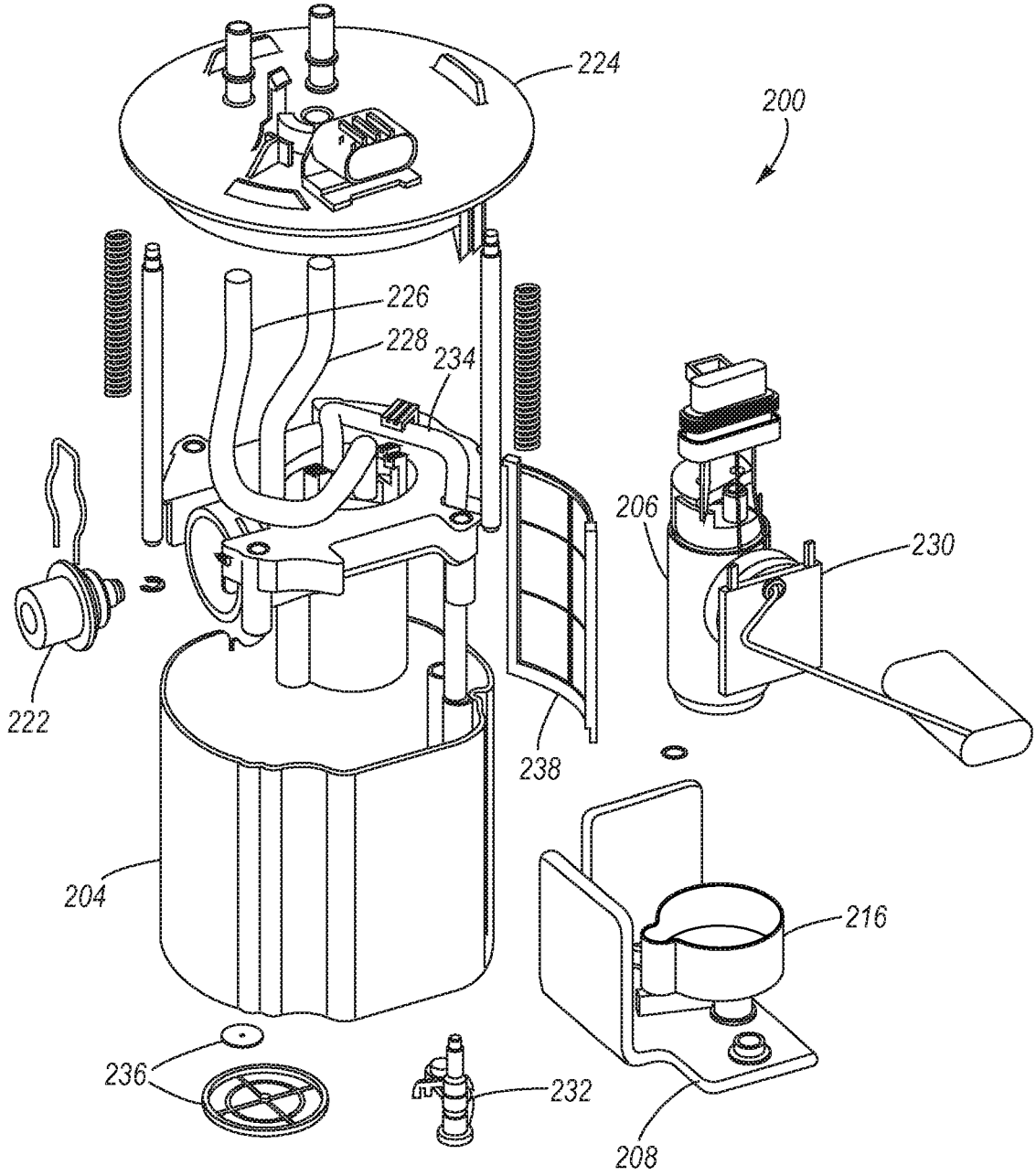
FIG. 5 is an exploded view of the anti-clogging fuel pump module of FIG. 4.

Turning attention now to FIGS. 4 and 5, an anti-clogging fuel pump module 200 is depicted, which is an implementation of the anti-clogging fuel pump module 100*c* of FIG. 3C.

The fuel pump module 200 has a module reservoir 202 defined by a plastic module sidewall 204. Strained fuel $F_S$ which has passed through a strainer 208 is pumped by a fuel pump 206, and delivered as strained pumped fuel $F_P$ to the engine via a feed fuel line 210 and in-line filter (not shown), wherein strained pumped fuel not utilized by the engine is by-passed, via an intersecting by-pass fuel line 212 located between the fuel pump 206 and the engine (not shown), as by-pass strained fuel $F_B$.

The strainer 208 delivers strained fuel $F_S$ to the fuel pump 206 via a strainer cup 216. A by-pass tube 218, which is in this case is rigid, directly connects to the strainer cup 216 downstream of the strainer 208 and upstream of the fuel pump 206, wherein there is no communication with the reservoir fuel $F_R$. Strained pumped fuel $F_P$ not used by the engine is by-passed, via a pressure regulator 222, through the by-pass tube 218 to the fuel pump 206, whereby the by-pass strained fuel $F_B$ is directly recirculated into the fuel pump. Reservoir (bulk) fuel $F_R$ is also drawn into the strainer 208 to augment the fuel flow requirement of the engine, wherein the strainer is also completely contained within the module reservoir.

As shown at FIG. 5, which is an exploded view of FIG. 4, additional parts include: a flange assembly 224, a delivery hose 226, a return hose 228, a float-type fuel level sensor assembly 230, a supply jet assembly 232, a supply jet hose 234, a protector strainer and check valve 236 of the strainer, and a reservoir protector strainer 238.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A fuel pump module for a by-pass fuel system, comprising:

a module reservoir;

a fuel pump disposed in said module reservoir;

a strainer fluidically communicating with said fuel pump upstream of said fuel pump;

a standpipe;

an internal channel formed in said strainer fluidically communicating with said stand pipe and said fuel pump; and by-pass fuel plumbing connected downstream of said fuel pump to said standpipe;

wherein fuel is flowingly pumped in response to pumping by said fuel pump, wherein the fuel is strained by said strainer upstream of said fuel pump, wherein said by-pass fuel plumbing delivers by-pass fuel directly to said fuel pump through said internal channel in upstream relation to said fuel pump and in downstream relation to said strainer, and wherein upstream and downstream are defined by the flow of the fuel.

2. A by-pass fuel system, comprising:

a module reservoir;

a fuel pump disposed in said module reservoir;

a standpipe;

a strainer fitting fluidically communicating with said stand pipe and said fuel pump;

a strainer intersected by said strainer fitting, said strainer fluidically communicating with said strainer fitting upstream of said fuel pump; and by-pass fuel plumbing connected downstream of said fuel pump to said stand pipe;

wherein fuel is flowingly pumped in response to pumping by said fuel pump, wherein the fuel is strained by said strainer upstream of said fuel pump, wherein said by-pass fuel plumbing delivers by-pass fuel directly to said fuel pump through said strainer fitting in upstream relation to said fuel pump and in downstream relation to said strainer, and wherein downstream and upstream are defined by the flow of the fuel.

* * * * *